US009768557B2

(12) United States Patent
Phillips et al.

(10) Patent No.: US 9,768,557 B2
(45) Date of Patent: Sep. 19, 2017

(54) ELECTRICAL CONNECTOR HAVING RESONANCE CONTROL

(71) Applicant: TYCO ELECTRONICS CORPORATION, Berwyn, PA (US)

(72) Inventors: Michael John Phillips, Camp Hill, PA (US); Thomas Taake de Boer, Hummelstown, PA (US); Bruce Allen Champion, Camp Hill, PA (US); John Joseph Consoli, Harrisburg, PA (US); Sandeep Patel, Middletown, PA (US); Linda Ellen Shields, Camp Hill, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 14/967,605

(22) Filed: Dec. 14, 2015

(65) Prior Publication Data

US 2017/0170606 A1 Jun. 15, 2017

(51) Int. Cl.

| | |
|---|---|
| ***H01R 13/648*** | (2006.01) |
| ***H01R 13/6471*** | (2011.01) |
| ***H01R 13/6585*** | (2011.01) |
| ***H01R 12/70*** | (2011.01) |

(52) U.S. Cl.

CPC ..... *H01R 13/6471* (2013.01); *H01R 12/7005* (2013.01); *H01R 13/6585* (2013.01)

(58) Field of Classification Search

CPC ..... H01R 13/652

USPC ..... 439/108, 637, 607.11, 607.05, 607.07

See application file for complete search history.

(56) References Cited

U.S. PATENT DOCUMENTS

| | | | | |
|---|---|---|---|---|
| 7,371,117 | B2 | 5/2008 | Gailus | |
| 7,771,233 | B2 | 8/2010 | Gailus | |
| 8,083,553 | B2 | 12/2011 | Manter et al. | |
| 8,177,564 | B1 | 5/2012 | Ito et al. | |
| 8,523,583 | B2 * | 9/2013 | Ito | H01R 12/721 439/108 |
| 2014/0127946 | A1 | 5/2014 | Ito et al. | |
| 2015/0056856 | A1 | 2/2015 | Atkinson et al. | |

OTHER PUBLICATIONS

Zhang, Li and Zhuan; Energy-efficient operation of Heavy Haul Trains in an MPC Framework; IEEE; 6 pages.

* cited by examiner

*Primary Examiner* — Phuong Dinh

(57) ABSTRACT

An electrical connector includes a housing having a first end and a second end with a mating slot formed between the first and second ends configured to receive a mating connector having contact pads. A leadframe assembly is disposed in the housing. The leadframe assembly has a contact array including ground contacts and signal contacts interspersed between corresponding ground contacts. The leadframe assembly has an overmold body supporting the ground and signal contacts. The overmold body has lossy ground absorbers coupled to corresponding ground contacts. The lossy ground absorbers are manufactured from lossy material absorbing electrical resonance propagating through the leadframe assembly.

19 Claims, 4 Drawing Sheets

ELECTRICAL CONNECTOR HAVING RESONANCE CONTROL

BACKGROUND OF THE INVENTION

The subject matter herein relates generally to electrical connectors having signal and ground contacts.

Some communication systems utilize electrical connectors mounted to a circuit board to interconnect other components for data communication. For example, the electrical connector may include a housing holding contacts terminated to the circuit board. The housing and contacts define a mating interface for mating with a mating connector such as a circuit card, a plug connector, and the like for connecting such mating connector to the circuit board. Some known electrical connectors have performance problems, particularly when transmitting at high data rates. For example, the electrical connectors typically utilize differential pair signal contacts to transfer high speed signals. Ground contacts improve signal integrity. However, electrical performance of known communication connectors, when transmitting the high data rates, is inhibited by noise from cross-talk and by return loss. Such issues are more problematic with small pitch high speed data connectors, which are noisy and exhibit higher than desirable return loss due to the close proximity of signal and ground contacts. Energy from ground contacts on either side of the signal pair may be reflected in the space between the ground contacts and such noise results in reduced connector performance and throughput.

A need remains for a high density, high speed electrical connector having reliable performance.

BRIEF DESCRIPTION OF THE INVENTION

In an embodiment, an electrical connector is provided including a housing having a first end and a second end. The housing has a mating slot formed between the first and second ends configured to receive a mating connector having contact pads. A leadframe assembly is disposed in the housing. The leadframe assembly has a contact array including ground contacts and signal contacts interspersed between corresponding ground contacts. The leadframe assembly has an overmold body supporting the ground and signal contacts. The overmold body has lossy ground absorbers coupled to corresponding ground contacts. The lossy ground absorbers are manufactured from lossy material absorbing electrical resonance propagating through the leadframe assembly.

In another embodiment, an electrical connector is provided including a housing having a first end and a second end. The housing has a mating slot formed between the first and second ends configured to receive a mating connector having contact pads. The electrical connector includes first and second leadframe assemblies disposed in the housing. The first leadframe assembly has a first contact array including ground contacts and signal contacts interspersed between corresponding ground contacts and a first overmold body supporting the ground and signal contacts. The first overmold body has upper lossy ground absorbers coupled to corresponding ground contacts. The upper lossy ground absorbers are manufactured from lossy material absorbing electrical resonance propagating through the first leadframe assembly. The second leadframe assembly has a second contact array including ground contacts and signal contacts interspersed between corresponding ground contacts and a second overmold body supporting the ground and signal contacts. The second overmold body has lower lossy ground absorbers coupled to corresponding ground contacts. The lower lossy ground absorbers are manufactured from lossy material absorbing electrical resonance propagating through the second leadframe assembly. The upper lossy ground absorbers are coupled to corresponding lower lossy ground absorbers to interconnect ground contacts of the first and second leadframe assemblies.

In a further embodiment, an electrical connector is provided including a housing having a first end and a second end and a mating slot formed between the first and second ends configured to receive a mating connector having contact pads. A leadframe assembly is disposed in the housing. The leadframe assembly has a contact array including ground contacts and signal contacts interspersed between corresponding ground contacts. The leadframe assembly has an overmold body supporting the ground and signal contacts. The overmold body has a low loss section manufactured from low loss dielectric material and a lossy section manufactured from lossy material absorbing electrical resonance propagating through the leadframe assembly. The lossy section has lossy ground absorbers coupled to corresponding ground contacts and a lossy tie bar spanning between the lossy ground absorbers to interconnect the lossy ground absorbers.

DETAILED DESCRIPTION OF THE INVENTION

Embodiments set forth herein may include various electrical connectors that are configured for communicating data signals. The electrical connectors may mate with a corresponding mating connector to communicatively interconnect different components of a communication system. In the illustrated embodiment, the electrical connector is a receptacle connector that is mounted to and electrically coupled to a circuit board. The receptacle connector is configured to mate with a pluggable input/output (I/O) connector during a mating operation. It should be understood, however, that the inventive subject matter set forth herein may be applicable in other types of electrical connectors. In various embodiments, the electrical connectors provide lossy ground absorbers to provide resonance control. Moreover, in various embodiments, the electrical connectors are particularly suitable for high-speed communication systems, such as network systems, servers, data centers, and the like, in which the data rates may be greater than 5 gigabits/second (Gbps). However, one or more embodiments may also be suitable for data rates less than 5 Gbps.

In various embodiments described and/or illustrated herein, the electrical connectors include signal and ground conductors that are positioned relative to each other to form a pattern or array that includes one or more rows (or columns). The signal and ground conductors of a single row (or column) may be substantially co-planar. The signal conductors form signal pairs in which each signal pair is flanked on both sides by ground conductors. The ground conductors electrically separate the signal pairs to reduce electromagnetic interference or crosstalk and to provide a reliable ground return path. The signal and ground conductors in a single row are patterned to form multiple sub-arrays. Each sub-array includes, in order, a ground conductor, a signal conductor, a signal conductor, and a ground conductor. This arrangement is referred to as ground-signal-signal-ground (or GSSG) sub-array. The sub-array may be repeated such that an exemplary row of conductors may form G-S-S-G-G-S-S-G-G-S-S-G, wherein two ground conductors are positioned between two adjacent signal pairs. In the illustrated embodiment, however, adjacent signal pairs share a ground conductor such that the pattern forms G-S-S-G-S-S-G-S-S-G. In both examples above, the sub-array is referred to as a GSSG sub-array. More specifically, the term "GSSG sub-array" includes sub-arrays that share one or more intervening ground conductors.

Figure 1:
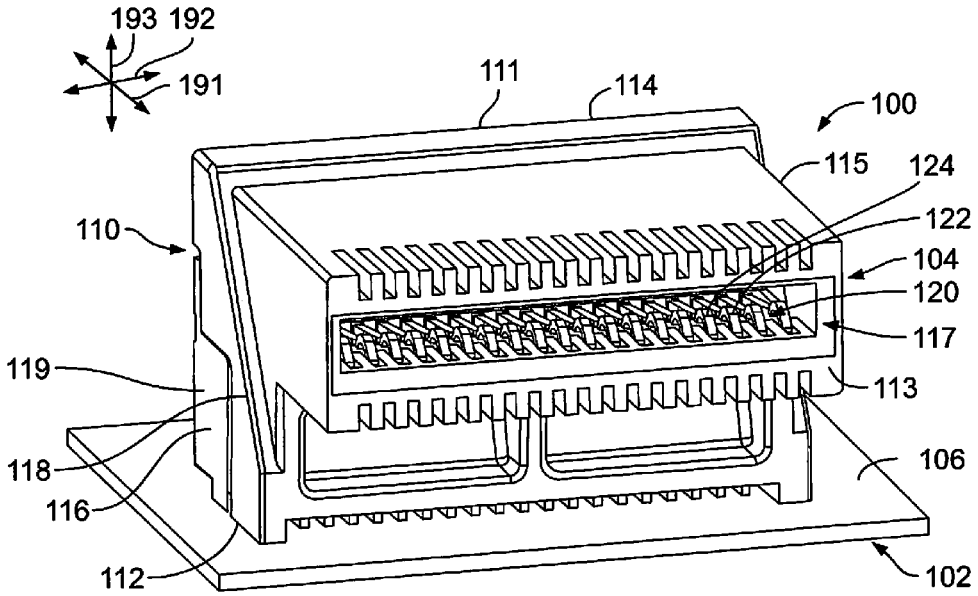
FIG. 1 is a front perspective view of a circuit board assembly including an electrical connector formed in accordance with an embodiment.
Figure 2:
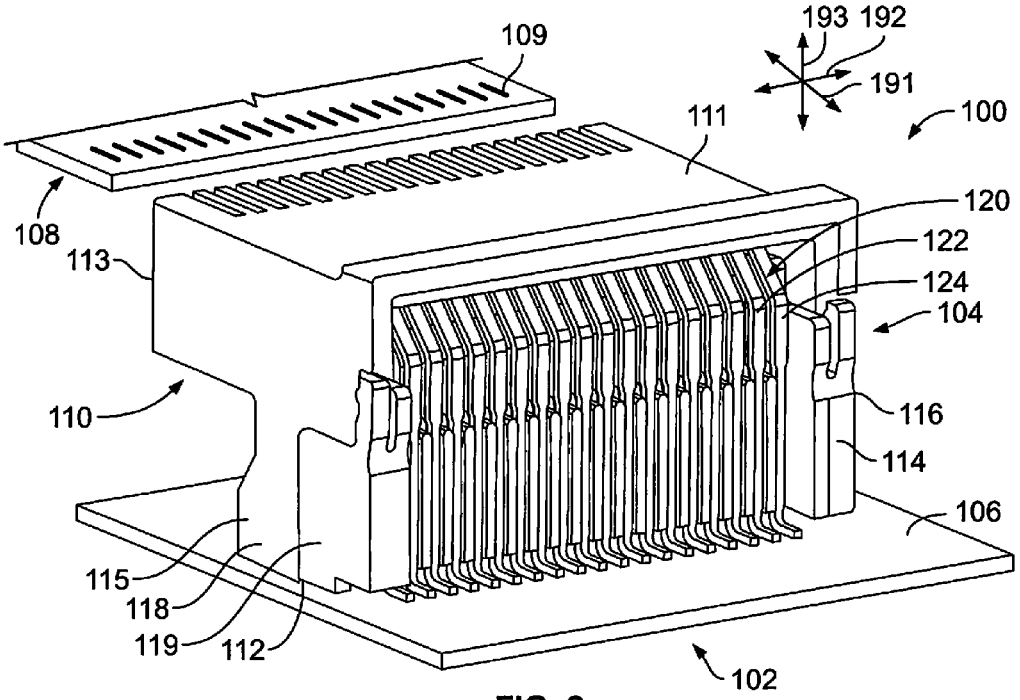
FIG. 2 is a rear perspective view of the circuit board assembly and electrical connector.

FIG. 1 is a front perspective view of a circuit board assembly 100 formed in accordance with an embodiment. FIG. 2 is a rear perspective view of the circuit board assembly 100. The circuit board assembly 100 includes a circuit board 102 and an electrical connector 104 that is mounted onto a board surface 106 of the circuit board 102. A mating connector 108 (FIG. 2) is configured to be mated with the electrical connector 104. In the illustrated embodiment, the mating connector 108 is or includes a circuit card, such as a paddle card style printed circuit board; however other types of mating components may be used in alternative embodiments. For example, the mating connector 108 may be a plug connector. The mating connector 108 includes contact pads 109 on one or both surfaces of the mating connector 108 configured to be electrically connected to corresponding contacts of the electrical connector 104.

The circuit board assembly 100 is oriented with respect to mutually perpendicular axes, including a mating axis 191, a lateral axis 192, and a vertical or elevation axis 193. In FIG. 1, the vertical axis 193 extends parallel to a gravitational force direction. It should be understood, however, that embodiments described herein are not limited to having a particular orientation with respect to gravity. For example, the lateral axis 192 or the mating axis 191 may extend parallel to the gravitational force direction in other embodiments. The mating connector 108 is mated with the electrical connector 104 along the mating axis 191.

In some embodiments, the circuit board assembly 100 may be a daughter card assembly that is configured to engage a backplane or midplane communication system (not shown). In other embodiments, the circuit board assembly 100 may include a plurality of the electrical connectors 104 mounted to the circuit board 102 along an edge of the circuit board 102 in which each of the electrical connectors 104 is configured to engage a corresponding pluggable input/output (I/O) connector, such as or including the mating connector 108. The electrical connectors 104 and mating connectors 108 may be configured to satisfy certain industry standards, such as, but not limited to, the small-form factor pluggable (SFP) standard, enhanced SFP (SFP+) standard, quad SFP (QSFP) standard, C form-factor pluggable (CFP) standard, and 10 Gigabit SFP standard, which is often referred to as the XFP standard. In some embodiments, the pluggable I/O connector may be configured to be compliant with a small form factor (SFF) specification, such as SFF-8644 and SFF-8449 HD. In some embodiments, the electrical connectors 104 described herein may be high-speed electrical connectors that are capable of transmitting data at a rate of at least about five (5) gigabits per second (Gbps). In some embodiments, the electrical connectors 104 described herein may be high-speed electrical connectors that are capable of transmitting data at a rate of at least about 10 Gbps, or more.

Although not shown, each of the electrical connectors 104 may be positioned within a receptacle cage. The receptacle cage may be configured to receive one or more of the mating connectors 108 during a mating operation and direct the mating connector 108 toward the corresponding electrical connector 104. The circuit board assembly 100 may also include other devices that are communicatively coupled to the electrical connectors 104 through the circuit board 102. The electrical connectors 104 may be positioned proximate to one edge of the circuit board 102.

The electrical connector 104 includes a housing 110 having a plurality of walls, including a first end 111, a second end 112, a front end 113, a rear end 114, a first side 115 and a second side 116. The housing 110 may include greater or fewer walls in alternative embodiments. The housing sides 115, 116 extend between the front and rear ends 113, 114 and the first and second ends 111, 112. The front end 113 and the rear end 114 face in opposite directions along the mating axis 191. The first and second sides 115, 116 face in opposite directions along the lateral axis 192. The first and second ends 111, 112 face in opposite directions along the vertical axis 193. The housing 110 extends a height between the first end 111 and the second end 112. The housing 110 extends a width between the front end 113 and the rear end 114. The housing 110 extends a length between the first and second sides 115, 116.

In the illustrated embodiment, the first end 111 defines a top end and may be referred to hereinafter as a top end 111 and the second end 112 defines a bottom end and may be referred to hereinafter as a bottom end 112. The bottom end 112 faces the board surface 106 and may be mounted to or engage the board surface 106. The top end 111 faces away from the circuit board 102 and may have the greatest elevation of the housing walls with respect to the board surface 106.

In the illustrated embodiment of FIG. 1, the electrical connector 104 is a right-angle connector such that the front end 113, which is the receiving side, and the bottom end 112, which is the mounting side, are oriented substantially perpendicular or orthogonal to each other. More specifically, the front end 113 faces in a receiving direction along the mating axis 191 and the mounting side faces in a mounting direction along the vertical axis 193. In other embodiments, the receiving side and the mounting side may face in different directions than those shown in FIG. 1. For example, the top end 111 may define the receiving side that receives the mating connector 108 such that the electrical connector 104 is a vertical connector rather than a right-angle connector.

The housing 110 includes a mating slot 117 (FIG. 1) that is sized and shaped to receive a portion of the mating connector 108. For example, in the illustrated embodiment, the mating slot 117 is sized and shaped to receive an edge of the mating connector 108, including the contact pads 109. The mating slot 117 is positioned between the first and second ends 111, 112. The mating slot 117 is open at the front end 113 with an upper portion of the housing 110 positioned between the mating slot 117 and the first end 111 and a lower portion of the housing 110 positioned between the mating slot 117 and the second end 112. The mating slot 117 is shown open at the front end 113; however the mating slot may have other locations in alternative embodiments, such as open at the top end 111.

In an exemplary embodiment, the housing 110 may be a multi-piece housing. For example, the housing 110 includes a front housing 118 and a rear housing 119. The front housing 118 is coupled to the rear housing 119 with the mating slot 117 therebetween. Optionally, the front housing 118 may extend along the front end 113 and the top end 111; however other configurations are possible in alternative embodiments.

The electrical connector 104 includes one or more contact arrays 120 disposed in the housing 110. For example, the contact array(s) 120 may be disposed between the front and rear housings 118, 119. The contact array 120 includes signal contacts 122 and ground contacts 124 that extend into the mating slot 117 for mating with corresponding contact pads 109. The signal and ground contacts 122, 124 also extend to the bottom end 112 for mounting to the circuit board 102. For example, ends of the signal and ground contacts 122, 124 may be surface mounted (for example, soldered) to the circuit board 102 or press-fit into plated vias in the circuit board 102 for mechanical and electrical connection to the circuit board 102.

The contact array(s) 120 is arranged in the housing 110 such that the signal and ground contacts 122, 124 are arranged in at least one row of contacts. In an exemplary embodiment, the signal and ground contacts 122, 124 are arranged in a first row and a second row. For example, the signal and ground contacts 122, 124 are arranged in an upper row and a lower row generally at the top end 111 and the bottom end 112, respectively (for example, arranged between the mating slot 117 and the top end 111 and between the mating slot 117 and the bottom end 112, respectively). The first and second rows of signal and ground contacts 122, 124 are arranged on opposite sides of the mating slot 117. The signal and ground contacts 122, 124 may be arranged in a front row and a rear row generally at the front end 113 and the rear end 114, respectively. In an exemplary embodiment, the first row defines both an upper row and a rear row as the corresponding signal and ground contacts 122, 124 are arranged both along the top end 111 and the rear end 114, and the second row defines both a lower row and a front row as the corresponding signal and ground contacts 122, 124 are arranged both along the bottom end 112 and the front end 113. The rows of contacts 122, 124 may be part of the same or different contact arrays 120.

Figure 3:
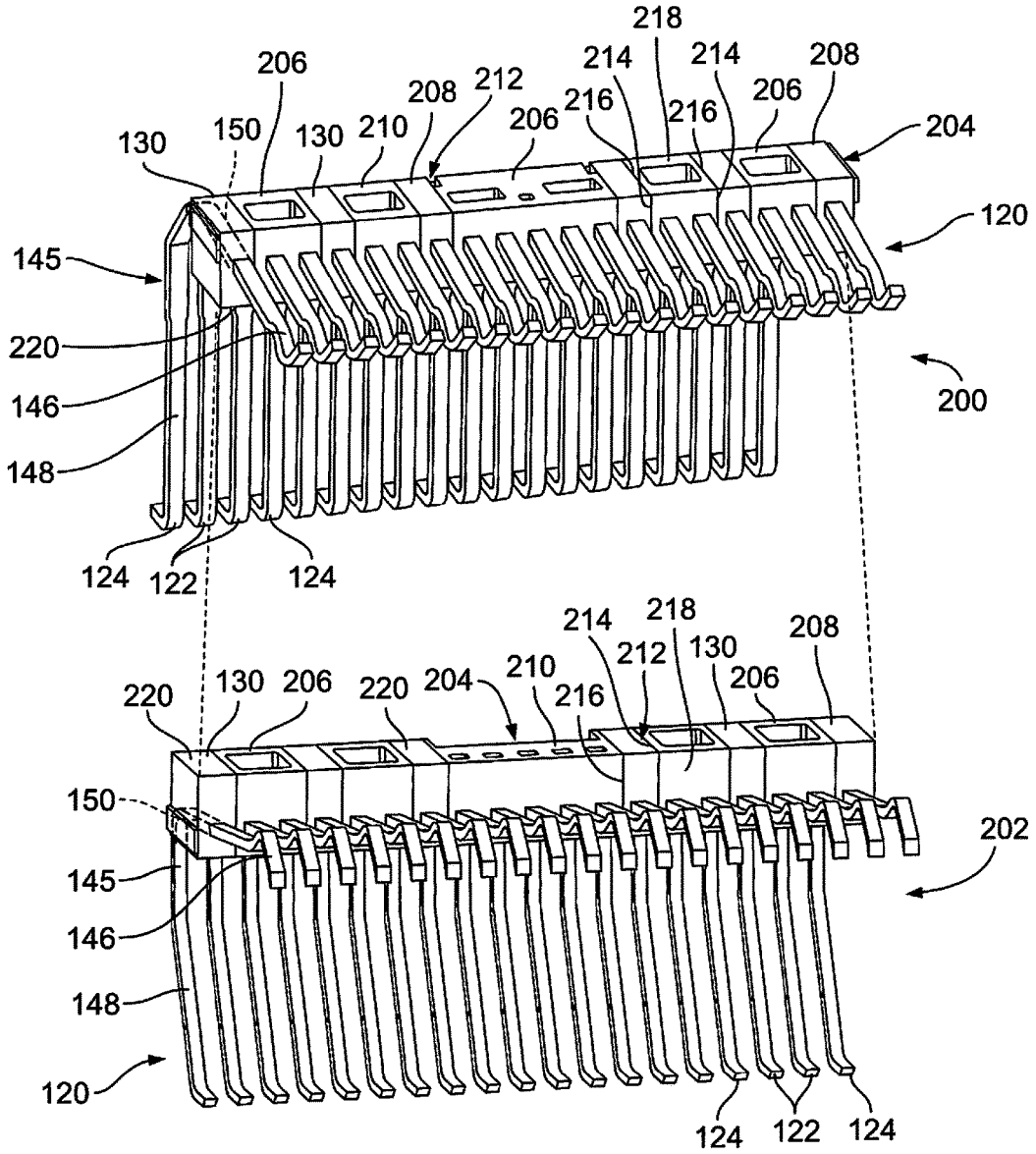
FIG. 3 is an exploded view of a portion of the electrical connector showing first and second leadframe assemblies formed in accordance with an exemplary embodiment.

The signal and ground contacts 122, 124 may be arranged to form a plurality of ground-signal-signal-ground (GSSG) sub-arrays in which each pair of signal contacts 122 is located between two ground contacts 124. The electrical connector 104 may also include at least one lossy ground absorber 130 (FIG. 3). The lossy ground absorber 130 may be a single piece or may be multiple pieces distributed throughout the housing 110 in select locations. Each of the lossy ground absorbers 130 is configured to absorb at least some electrical resonance that propagates along the current path defined by the ground contacts 124 and/or at least some electrical resonance that propagates along the signal path defined by the corresponding signal contacts 122. The lossy ground absorber 130 may be coupled to one or more ground contacts 124, such as directly coupled to the one or more ground contacts 124 at a ground contact interface that directly engages the corresponding ground contact 124. The lossy ground absorber 130 may control or limit undesirable resonances that occur within the ground contacts 124 during operation of the electrical connector 104. The lossy ground absorber 130 may effectively reduce the frequency of energy resonating within the housing 110. The housing 110 is manufactured from a low loss dielectric material, such as a plastic material. The low loss dielectric material has dielectric properties that have relatively little variation with frequency.

The lossy ground absorber 130 may be provided at or near the rear end 114 to couple to one or more ground contacts 124 in the rear row. The lossy ground absorber 130 may be provided at or near the front end 113 to couple to one or more ground contacts 124 in the front row. Optionally, the lossy ground absorber 130 may extend a distance between the front end 113 and the rear end 114 to couple to ground contacts 124 in both the front and rear rows. The lossy ground absorber 130 may be provided at or near the top end 111 to couple to one or more ground contacts 124 in the upper row. The lossy ground absorber 130 may be provided at or near the bottom end 112 to couple to one or more ground contacts 124 in the lower row and/or the upper row. Optionally, the lossy ground absorber 130 may extend length-wise to couple to multiple ground contacts 124 in the first row, in the second row, or in both the first and second rows. Optionally, the lossy ground absorber 130 may extend across and couple to ground contacts 124 of multiple GSSG sub-arrays.

In an exemplary embodiment, the lossy ground absorber 130 includes lossy material configured to absorb at least some electrical resonance that propagates along the current paths defined by the signal contacts 122 and/or the ground contacts 124 through the electrical connector 104. For example, the lossy material may be embedded in the housing 110. The lossy material has dielectric properties that vary with frequency. The lossy material provides lossy conductivity and/or magnetic lossiness through a portion of the electrical connector 104. The lossy material is able to conduct electrical energy, but with at least some loss. The lossy material is less conductive than conductive material, such as the conductive material of the contacts 122, 124. The lossy material may be designed to provide electrical loss in a certain, targeted frequency range, such as by selection of the lossy material, placement of the lossy material, proximity of the lossy material to the ground paths and the signal paths, and the like. The lossy material may include conductive particles (or fillers) dispersed within a dielectric (binder) material. The dielectric material, such as a polymer or epoxy, is used as a binder to hold the conductive particle filler elements in place. These conductive particles then impart loss to the lossy material. In some embodiments, the lossy material is formed by mixing binder with filler that includes conductive particles. Examples of conductive particles that may be used as a filler to form electrically lossy materials include carbon or graphite formed as fibers, flakes, or other particles. Metal in the form of powder, flakes, fibers, or other conductive particles may also be used to provide suitable lossy properties. Alternatively, combinations of fillers may be used. For example, metal plated (or coated) particles may be used. Silver and nickel may also be used to plate particles. Plated (or coated) particles may be used alone or in combination with other fillers, such as carbon flakes. In some embodiments, the fillers may be present in a sufficient volume percentage to allow conducting paths to be created from particle to particle. For example when metal fiber is used, the fiber may be present at an amount up to 40% by volume or more. The lossy material may be magnetically lossy and/or electrically lossy. For example, the lossy material may be formed of a binder material with magnetic particles dispersed therein to provide magnetic properties. The magnetic particles may be in the form of flakes, fibers, or the like. Materials such as magnesium ferrite, nickel ferrite, lithium ferrite, yttrium garnet and/or aluminum garnet may be used as magnetic particles. In some embodiments, the lossy material may simultaneously be an electrically-lossy material and a magnetically-lossy material. Such lossy materials may be formed, for example, by using magnetically-lossy filler particles that are partially conductive or by using a combination of magnetically-lossy and electrically-lossy filler particles As used herein, the term "binder" encompasses material that encapsulates the filler or is impregnated with the filler. The binder material may be any material that will set, cure, or can otherwise be used to position the filler material. In some embodiments, the binder may be a thermoplastic material such as those traditionally used in the manufacture of electrical connector housings. The thermoplastic material may be molded, such as molding of the lossy ground absorber 130 into the desired shape and/or location. However, many alternative forms of binder materials may be used. Curable materials, such as epoxies, can serve as a binder. Alternatively, materials such as thermosetting resins or adhesives may be used.

Electrical performance of the communication connector 104 is enhanced by the inclusion of the lossy material in the lossy ground absorbers 130. For example, at various data rates, including high data rates, return loss is inhibited by the lossy material. For example, the return loss of the small pitch, high speed data of the contact arrays 120 due to the close proximity of signal and ground contacts 122, 124 is reduced by the lossy ground absorbers 130. For example, energy from the ground contacts 124 on either side of the signal pair reflected in the space between the ground contacts 124 is absorbed, and thus connector performance and throughput is enhanced.

FIG. 3 is an exploded view of a portion of the electrical connector 104 showing first and second leadframe assemblies 200, 202 formed in accordance with an exemplary embodiment. Each leadframe assembly 200, 202 includes one of the contact arrays 120 and an overmolded body 204 supporting the ground contacts 124 and the signal contacts 122 of the contact arrays 120. The leadframe assemblies 200, 202 may be stacked with the first leadframe assembly 200 above the second leadframe assembly 202. As such, the first leadframe assembly 200 may be an upper leadframe assembly and the second leadframe assembly 202 may be a lower leadframe assembly with the corresponding component parts identified with such upper and lower identifiers, such as an upper contact array or an upper overmold body, and the like. The first and second leadframe assemblies 200, 202 may be assembled together within the housing 110 (shown in FIG. 1) either prior to loading in the housing 110 or after loading in the housing 110. Optionally, the first leadframe assembly 200 may be loaded into the rear housing 119 (shown in FIG. 1) and the second leadframe assembly 202 may be loaded into the front housing 118 (shown in FIG. 1) and then coupled together when the front and rear housing 118, 119 are coupled together.

The upper and lower overmold bodies 204 each have low loss sections 206 and lossy sections 208. For example, the low loss sections 206 may be manufactured from a low loss dielectric material, such as a plastic material. The low loss dielectric material has dielectric properties that have relatively little variation with frequency. The overmold bodies 204 may include main bodies 210 that define the low loss sections 206. The main bodies 210 may be molded over the signal contacts 122 using the low loss dielectric material. The lossy sections 208 are manufactured from lossy material. The lossy sections 208 may be defined by the lossy ground absorbers 130. The lossy ground absorbers 130 may be molded over the ground contacts 124 and directly engage the ground contacts 124 at ground contact interfaces.

During manufacture, the signal and ground contacts 122, 124 may be stamped and formed contacts defining leadframes. The leadframes arrange the contacts in an array, and carrier strips of the leadframe may be removed after stamping and forming to define the contact array 120. The leadframes are overmolded to form the overmold bodies 204. Optionally, the leadframes may be overmolded in a multi-stage molding process where the main bodies 210 are molded in a first stage and the lossy ground absorbers 130 are molded in a second stage, or vice versa. The lossy ground absorbers 130 may be co-molded with the main bodies 210 in a multi-shot molding process, such as a two-shot molding process, where the main bodies 210 and the lossy ground absorbers 130 are molded from different materials, such as a low loss plastic material and a lossy material, respectively.

The main bodies 210 include pockets 212 that receive corresponding lossy ground absorbers 130. The pockets 212 are defined by side walls 214. The lossy ground absorbers 130 have sides 216 against the side walls 214. Optionally, the lossy ground absorbers 130 may be molded in place in the pockets 212 against the side walls 214. Alternatively, the lossy ground absorbers 130 may be molded first and the main bodies 210 may be molded around the lossy ground absorbers 130 with the side walls 214 molded against the sides 216. In other alternative embodiments, the lossy ground absorbers 130 may be molded separately and inserted into the pockets 212. The main bodies 210 include blocks 218 between the pockets 212. Optionally, the blocks 218 may be tied together, such as along the top and/or the bottom of the corresponding main body 210 and/or through the lossy ground absorbers 130. In the illustrated embodiment, the lossy ground absorbers 130 are separated from each other by the blocks 218. In alternative embodiments, the lossy ground absorbers 130 may be tied together, such as along the top and/or bottom of the corresponding main bodies 210 and/or through the blocks 218.

In an exemplary embodiment, the lossy ground absorbers 130 include absorber interfaces 220 along the interior edges thereof (for example, between the sides 216 along the bottom surfaces of the upper lossy ground absorbers 130 and along the top surfaces of the lower lossy ground absorbers 130). When the upper and lower ground leadframe assemblies 200, 202 are coupled together, the absorber interfaces 220 may abut against each other to connect the aligned upper and lower lossy ground absorbers 130. The ground contacts 124 in the upper and lower contact arrays 120 are connected by the corresponding upper and lower lossy ground absorbers 130.

The signal contacts 122 in the first leadframe assembly 200 may also be identified specifically as upper or rear signal contacts, and the ground contacts 124 in the first leadframe assembly 200 may also be identified specifically as upper or rear ground contacts, while the signal and ground contacts 122, 124 in the second leadframe assembly 202 may be identified as lower or front signal and ground contacts. The upper and lower contacts 122, 124 generally have similar features, which may be referred to herein with like reference numerals; however, the upper and lower contacts 122, 124 may be shaped differently. The contacts 122, 124 each have a main body 145 extending between a mating end 146 and a terminating end 148. The contacts 122, 124 may have a deflectable mating beam at the mating end 146 for mating with the contact pads 109 of the mating connector 108 (both shown in FIG. 1). The contacts 122, 124 may have a solder tail at the terminating end 148 for surface mounting to the circuit board 102 (shown in FIG. 1). Other types of mating or terminating portions may be provided in alternative embodiments, such as a compliant pin at the terminating end 148.

In an exemplary embodiment, the contacts 122, 124 include an encased segment 150, such as along the mating beam, the solder tail or at another portion therebetween along the main body 145. The encased segment 150 is encased by the corresponding overmold body 204. The encased segment 150 of each signal contact 122 is encased by the main body 210 while the encased segment 150 of each ground contact 124 is encased by the lossy ground absorber 130. As such, the lossy ground absorbers 130 physically engage the ground contacts 124 at ground contact interfaces and are positioned relative to the ground contacts 124 to absorb at least some electrical resonance that propagates along the current paths defined by the ground contacts 124. The lossy ground absorbers 130 are positioned in proximity to the signal contacts 122, such as near but not physically engaged with the signal contacts 122, to absorb at least some electrical resonance that propagates along the current paths defined by the signal contacts 122.

Figure 4:
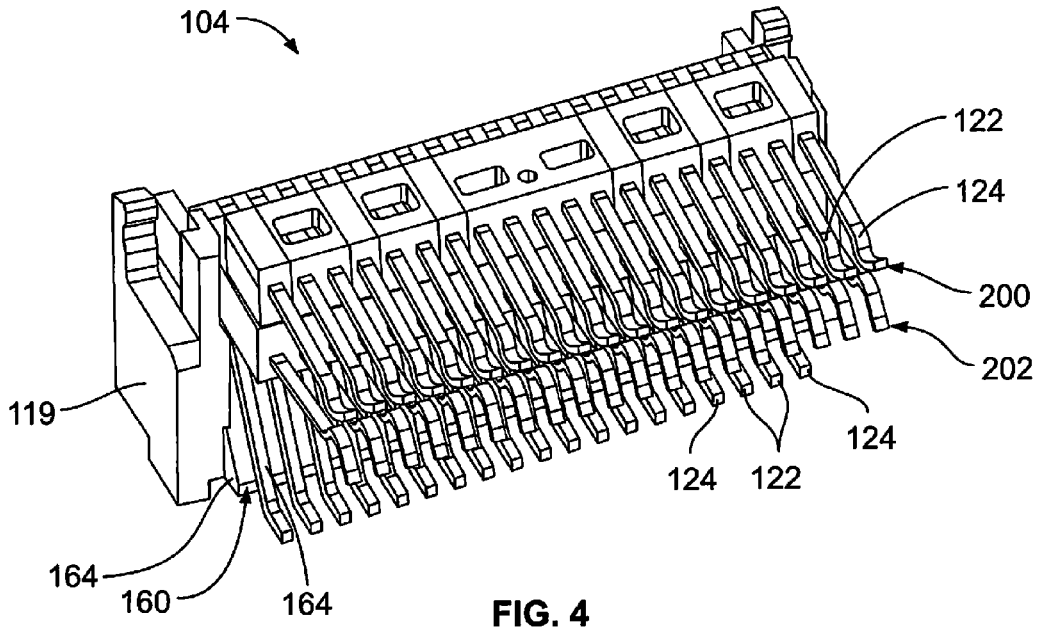
FIGS. 4 and 5 are front and rear perspective views of a portion of the electrical connector showing the leadframe assemblies loaded into a rear housing.
Figure 5:
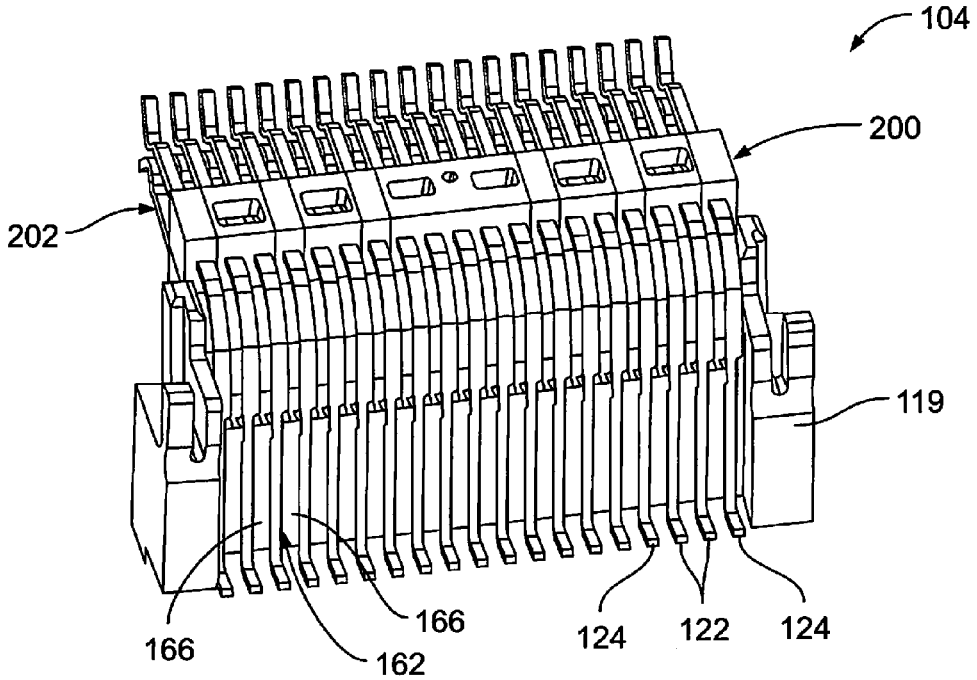

FIG. 4 is a front perspective view of a portion of the electrical connector 104 showing the first and second leadframe assemblies 200, 202 loaded into the rear housing 119. FIG. 5 is a rear perspective view of a portion of the electrical connector 104 showing the first and second leadframe assemblies 200, 202 loaded into the rear housing 119. The front housing 118 (shown in FIG. 1) may be coupled to the rear housing 119 over the leadframe assemblies 200, 202, such as from the front. In an exemplary embodiment, the rear housing 119 operates as a contact organizer organizing and aligning the signal and ground contacts 122, 124 of both leadframe assemblies 200, 202. For example, the rear housing 119 includes front contact channels 160 (FIG. 4) receiving the lower signal and ground contacts 122, 124. The rear housing 119 includes rear contact channels 162 (FIG. 5) receiving the upper signal and ground contacts 122, 124.

The front contact channels 160 are open at the front end of the rear housing 119 and spacers 164 are provided at opposite sides of each of the contact channels 160. The spacers 164 may hold and position the lower contacts 122, 124 in the contact channels 160. The rear contact channels 162 are open at the rear end of the rear housing 119 and spacers 166 are provided at opposite sides of each of the contact channels 162. The spacers 166 may hold and position the upper contacts 122, 124 in the contact channels 162.

Figure 6:
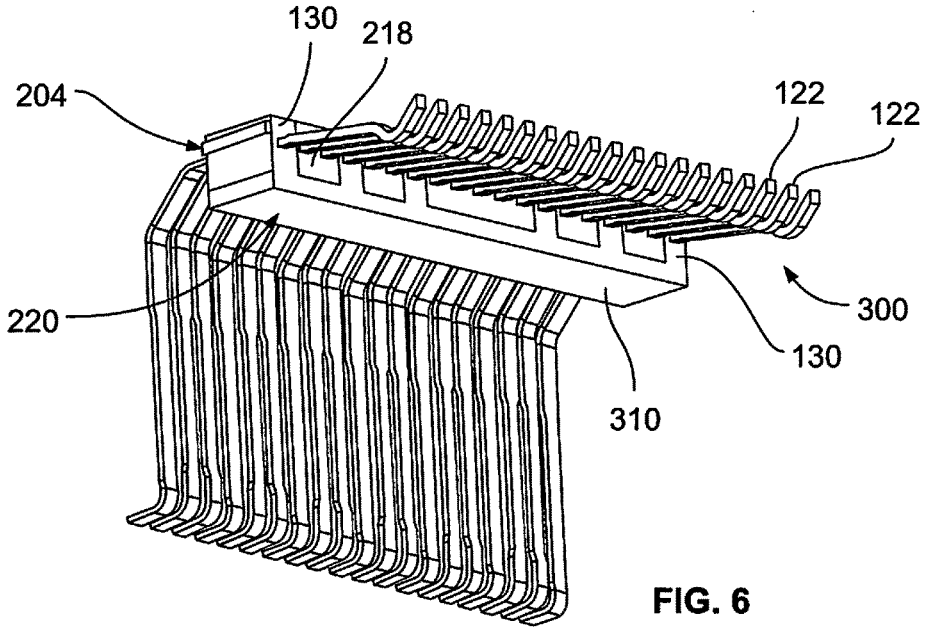
FIG. 6 is a perspective view of an upper leadframe assembly in accordance with an exemplary embodiment.

FIG. 6 is a perspective view of an upper leadframe assembly 300 in accordance with an exemplary embodiment. The upper leadframe assembly 300 is similar to the upper leadframe assembly 200 (shown in FIG. 3) and like parts are identified with like reference numerals. The upper leadframe assembly 300 includes a lossy tie bar 310 electrically connecting each of the lossy ground absorbers 130. The tie bar 310 spans across the blocks 218 along the bottom of the overmold body 204. The bottom of the lossy tie bar 310 defines the absorber interface 220. The lossy tie bar 310 spans between the lossy ground absorbers 130 across the pairs of signal contacts 122.

Figure 7:
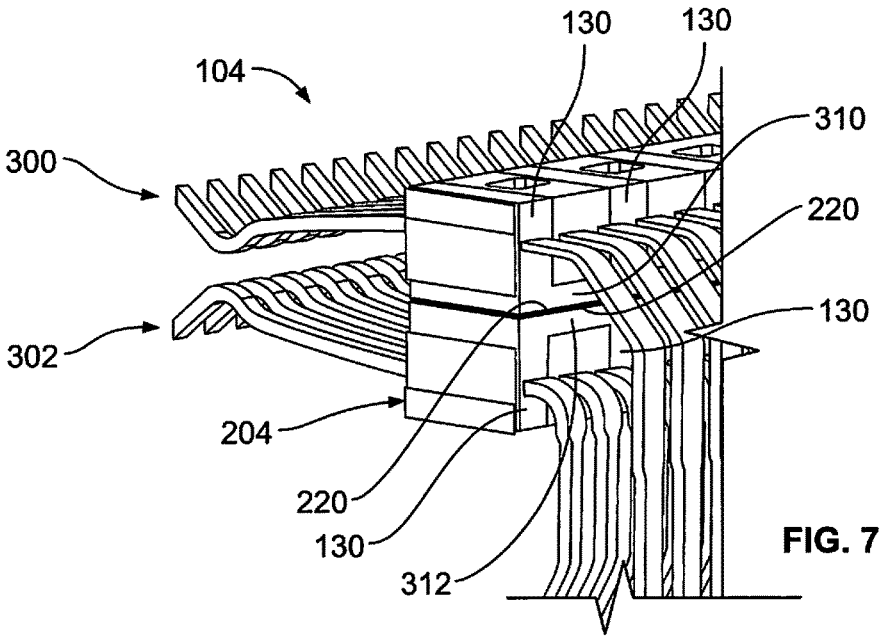
FIG. 7 is a rear perspective view of a portion of the electrical connector showing the upper leadframe assembly shown in FIG. 6 and a lower leadframe assembly.

FIG. 7 is a rear perspective view of a portion of the electrical connector 104 showing the upper leadframe assembly 300 and a lower leadframe assembly 302. The upper and lower leadframe assemblies 300, 302 may be disposed in the housing 110 (shown in FIG. 1). The lower leadframe assembly 302 is similar to the lower leadframe assembly 202 (shown in FIG. 3) and like parts are identified with like reference numerals. Similar to the upper leadframe assembly 300, the lower leadframe assembly 302 includes a lossy tie bar 312 along a top of the overmold body 204. The lossy tie bar 312 defines the absorber interface 220. The lossy tie bar 312 engages and is electrically connected to the lossy tie bar 310. Each of the upper and lower lossy ground absorbers 130 are electrically connected by the lossy tie bars 310, 312. In alternative embodiments, only one of the lossy tie bars 310 or 312 is needed to connect each of the upper and lower lossy ground absorbers 130.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a housing having a first end and a second end, the housing having a mating slot formed between the first and second ends, the mating slot being configured to receive a mating connector having contact pads; and a leadframe assembly disposed in the housing, the leadframe assembly having a contact array including ground contacts and signal contacts interspersed between corresponding ground contacts, and an overmold body supporting the ground and signal contacts, the overmold body having lossy ground absorbers engaging and being electrically coupled to corresponding ground contacts, the lossy ground absorbers manufactured from lossy material absorbing electrical resonance propagating through the leadframe assembly, wherein the lossy ground absorbers each include a ground contact interface engaging the corresponding ground contact to connect the lossy ground absorbers to the ground contacts.

2. The electrical connector of claim 1, wherein the signal contacts and the ground contacts are held together by the overmold body.

3. The electrical connector of claim 1, wherein the overmold body includes a main body having pockets receiving the lossy ground absorbers, the main body being manufactured from low loss material.

4. The electrical connector of claim 3, wherein the main body includes side walls defining the pockets, the lossy ground absorbers including sides against the side walls.

5. The electrical connector of claim 3, wherein the main body includes blocks of the low loss material between the pockets and the lossy ground absorbers, the blocks being tied together.

6. The electrical connector of claim 1, wherein the overmold body includes a main body being manufactured from low loss material and molded around the signal contacts, the lossy ground absorbers being co-molded with the main body and molded around the ground contacts.

7. The electrical connector of claim 1, wherein each lossy ground absorber is coupled to at least two ground contacts.

8. The electrical connector of claim 1, wherein the ground contacts are arranged in a row with a pair of signal contacts between each of the ground contacts, the overmold body including a lossy tie bar spanning between the lossy ground absorbers across the pair of signal contacts.

9. The electrical connector of claim 1, wherein the leadframe assembly defines a first leadframe assembly, the electrical connector further comprising a second leadframe assembly disposed in the housing below the first leadframe assembly, the second leadframe assembly having a contact array including ground contacts and signal contacts interspersed between corresponding ground contacts, and an overmold body supporting the ground and signal contacts, the overmold body of the second leadframe assembly having lossy ground absorbers coupled to corresponding ground contacts, wherein the lossy ground absorbers of the first leadframe assembly are coupled to corresponding lossy ground absorbers of the second leadframe assembly to interconnect ground contacts of the first and second leadframe assemblies.

10. The electrical connector of claim 1, wherein the housing includes a front housing and a rear housing, the leadframe assembly being disposed in and supported by at least one of the front housing and the rear housing.

11. The electrical connector of claim 1, wherein the lossy ground absorbers each include an edge defining an absorber interface engaging another lossy ground absorber.

12. An electrical connector comprising:

a housing having a first end and a second end, the housing having a mating slot formed between the first and second ends, the mating slot being configured to receive a mating connector having contact pads;

a first leadframe assembly disposed in the housing, the first leadframe assembly having a first contact array including ground contacts and signal contacts interspersed between corresponding ground contacts and a first overmold body supporting the ground and signal contacts, the first overmold body having upper lossy ground absorbers coupled to corresponding ground contacts, the upper lossy ground absorbers manufactured from lossy material absorbing electrical resonance propagating through the first leadframe assembly, and a second leadframe assembly disposed in the housing, the second leadframe assembly having a second contact array including ground contacts and signal contacts interspersed between corresponding ground contacts and a second overmold body supporting the ground and signal contacts, the second overmold body having lower lossy ground absorbers coupled to corresponding ground contacts, the lower lossy ground absorbers manufactured from lossy material absorbing electrical resonance propagating through the second leadframe assembly, wherein the upper lossy ground absorbers are coupled to corresponding lower lossy ground absorbers to interconnect ground contacts of the first and second leadframe assemblies.

13. The electrical connector of claim 12, wherein the upper lossy ground absorbers include edges defining absorber interfaces and wherein the lower lossy ground absorbers include edges defining absorber interfaces abutting against the absorber interfaces of corresponding upper lossy ground absorbers.

14. The electrical connector of claim 12, wherein the first overmold body includes a main body being manufactured from low loss material and molded around the signal contacts of the first contact array, the upper lossy ground absorbers being co-molded with the main body of the first overmold body and being molded around the ground contacts of the first contact array, and wherein the second overmold body includes a main body being manufactured from low loss material and molded around the signal contacts of the second contact array, the lower lossy ground absorbers being co-molded with the main body of the second overmold body and being molded around the ground contacts of the second contact array.

15. The electrical connector of claim 12, wherein the ground contacts of the first contact array are arranged in a row with a pair of signal contacts of the first contact array between the ground contacts, the first overmold body including an upper lossy tie bar spanning between and connecting the upper lossy ground absorbers across the pair of signal contacts, the upper lossy tie bar being manufactured from a same lossy material as the upper lossy ground absorbers, and wherein the ground contacts of the second contact array are arranged in a row with a pair of signal contacts of the second contact array between the ground contacts, the second overmold body including a lower lossy tie bar spanning between and connecting the lower lossy ground absorbers across the pair of signal contacts, the lower lossy tie bar being manufactured from a same lossy material as the lower lossy ground absorbers, the lower lossy tie bar abutting against and being connected to the upper lossy tie bar.

16. An electrical connector comprising:

a housing having a first end and a second end, the housing having a mating slot formed between the first and second ends, the mating slot being configured to receive a mating connector having contact pads; and a leadframe assembly disposed in the housing, the leadframe assembly having a contact array including ground contacts and signal contacts interspersed between corresponding ground contacts, the leadframe assembly having an overmold body supporting the ground and signal contacts, the overmold body having a low loss section manufactured from low loss dielectric material and a lossy section manufactured from lossy material absorbing electrical resonance propagating through the leadframe assembly, the lossy section having lossy ground absorbers engaging and being electrically coupled to corresponding ground contacts and a lossy tie bar spanning between the lossy ground absorbers to interconnect the lossy ground absorbers.

17. The electrical connector of claim 16, wherein the ground contacts are arranged in a row with a pair of signal contacts between each of the ground contacts, the lossy tie bar spanning across the pair of signal contacts.

18. The electrical connector of claim 16, wherein the overmold body includes a main body having pockets receiving the lossy ground absorbers, the main body being manufactured from low loss material, the lossy tie bar spanning across the main body between the pockets and the lossy ground absorbers in the pockets.

19. The electrical connector of claim 16, wherein the leadframe assembly defines a first leadframe assembly, the electrical connector further comprising a second leadframe assembly disposed in the housing below the first leadframe assembly, the second leadframe assembly having a contact array including ground contacts and signal contacts interspersed between corresponding ground contacts, and an overmold body supporting the ground and signal contacts, the overmold body of the second leadframe assembly having a low loss section manufactured from low loss dielectric material and a lossy section manufactured from lossy material absorbing electrical resonance propagating through the leadframe assembly, the lossy section having lossy ground absorbers coupled to corresponding ground contacts and a lossy tie bar spanning between the lossy ground absorbers to interconnect the lossy ground absorbers, wherein the lossy tie bar of the first leadframe assembly is coupled to the lossy tie bar of the second leadframe assembly.

* * * * *